US007406780B2

(12) United States Patent
Doh et al.

(10) Patent No.: US 7,406,780 B2
(45) Date of Patent: Aug. 5, 2008

(54) LAUNDRY DRYER AIR GUIDE PRESSURE/FRICTION ALTERING FEATURE

(75) Inventors: Young Jin Doh, Busan-si (KR); Soon Jo Lee, Changwon-si (KR); Young Hwan Park, Seoul (KR); Jun Seok Lee, Dongu-si (KR); Kyung Seop Hong, Icheon-si (KR); Soo Won Park, Icheon-si (KR); Hwan Joo Myung, Suwon-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/471,590

(22) Filed: Jun. 21, 2006

(65) Prior Publication Data

US 2006/0236560 A1 Oct. 26, 2006

Related U.S. Application Data

(62) Division of application No. 11/013,422, filed on Dec. 17, 2004, now Pat. No. 7,093,377.

(30) Foreign Application Priority Data

Dec. 19, 2003 (KR) ..... 10-2003-0093671
Dec. 19, 2003 (KR) ..... 10-2003-0093672
Dec. 26, 2003 (KR) ..... 10-2003-0097561

(51) Int. Cl.
*F26B 11/02* (2006.01)

(52) U.S. Cl. ..... 34/606

(58) Field of Classification Search ..... 34/595, 34/601, 602, 603, 604, 606
See application file for complete search history.

(56) References Cited

U.S. PATENT DOCUMENTS 5,203,400 A 4/1993 Tsunekawa et al.
5,555,647 A * 9/1996 Torborg et al. ..... 34/601
6,298,681 B1 * 10/2001 Esty et al. ..... 62/277
6,874,248 B2 * 4/2005 Hong et al. ..... 34/239

* cited by examiner

*Primary Examiner*—S. Gravini
(74) *Attorney, Agent, or Firm*—Birch, Stewart, Kolasch & Birch, LLP

(57) ABSTRACT

There is provided an air inlet structure of a laundry dryer. In the air inlet structure, a base defines an air inlet, a front cabinet is disposed in front of the base and defines a suction hole to pass ambient air into the base, a cooling fan is stably disposed in the base to suck the ambient air, a blower tube forms a flow passage for the ambient air, a blower cover is fixed to the base to connect the blower tube and the cooling fan, and an air guide is disposed between the base and the blower cover, the air guide having a shroud at a center portion.

14 Claims, 10 Drawing Sheets

LAUNDRY DRYER AIR GUIDE PRESSURE/FRICTION ALTERING FEATURE

This application is a Divisional of application Ser. No. 11/013,422, now U.S. Pat. No. 7,093,377 filed on Dec. 17, 2004 and for which priority is claimed under 35 U.S.C. § 120. This application claims priority of Korean Application Nos. 10-2003-0093671 filed Dec. 19, 2003, 10-2003-0093672 filed Dec. 19, 2003, and 10-2003-0097561 filed Dec. 26, 2003 under 35 U.S.C. § 119, the entire contents of which are hereby incorporated by reference.

BACKGROUND OF THE INVENTION

1. Field of the Invention

The present invention relates to a laundry dryer and an air inlet structure thereof, and more particularly, to an air inlet structure of a laundry dryer, in which an ambient air is smoothly sucked into a condenser for a heat exchange with a high-temperature/damp circulation air, and then smoothly discharged from the dryer.

2. Description of the Related Art

Generally, a drum-type laundry dryer is a home appliance, in which a heat source such as an electric heater and a gas combustion device is used to heat air and the heated air is blown into a drum to evaporate the remaining moisture in laundry.

The drum-type laundry dryer may be classified into a condenser-type dryer and an exhaust-type dryer. The former is designed such that the air in the dryer is used to dry the laundry as it is circulated in the dryer. The latter is designed such that air introduced in the dryer is used to dry the laundry and then the air is discharged from the dryer.

The exhaust-type laundry dryer may also be classified into a gas-type dryer and an electric-type dryer, according to the type of heater that heats the introduced air. In the gas-type dryer, a heat includes a furnace in which a fuel gas burns, an igniter, and a flame sensor, such that the air introduced in the dryer can be heated by the heat generated at the furnace. The electric-type dryer uses an electric heater that has a heating coil to heat the air introduced in the dryer, such that the laundry can be dried by the electrically heated air.

The condenser-type laundry dryer includes a front cover, a suction hole defined at a lower portion of the front cover to pass ambient air therethrough, a base disposed inside the suction hole, a condenser mounted in the base, and a fan inside the suction hole. The base defines an air inlet that is connected with the suction hole, an air passage, such that ambient air can be introduced through the suction hole and the air inlet, for exchanging heat with circulation air in the dryer.

The condenser-type dryer requires a structure that can introduce the ambient air from the suction hole to the fan in a smooth and efficient manner.

Further, the condenser-type dryer requires a structure that can minimize fluid loss and noise that are caused by fluid friction during the introduction of the ambient air into the dryer.

SUMMARY OF THE INVENTION

Accordingly, the present invention is directed to a laundry dryer and an air inlet structure thereof that substantially obviates one or more problems due to limitations and disadvantages of the related art.

An object of the present invention is to provide a laundry dryer and air inlet structure thereof, in which the noise caused by collision between sucking ambient air and a surface of a base can be reduced, and the loss caused by flow friction can be reduced.

Another object of the present invention is to provide a laundry dryer and air inlet structure thereof, in which an air inlet structure is improved such that the suction efficiency of a fan can be increased.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an air inlet structure of a laundry dryer, including: a base defining an air inlet; a front cabinet disposed in front of the base and defining a suction hole to pass ambient air into the base; a cooling fan stably disposed in the base to suck the ambient air; a blower tube forming a flow passage for the ambient air; a blower cover fixed to the base to connect the blower tube and the cooling fan; and an air guide disposed between the base and the blower cover, the air guide having a shroud at a center portion.

In another aspect of the present invention, there is provided an air inlet structure of a laundry dryer, including: a blower cover including an extended portion bent and extended by a predetermined length from an end thereof, a cover fixing tab protruded upwardly by a predetermined length from the other end thereof, and at least one guide protrusion projected from a bottom surface of the extended portion; a base on which the blower cover is mounted, the base including a tab keeper to hold the cover fixing tab; an air guide disposed between the base and the blower cover; a cooling fan stably disposed between the base and the blower cover, for sucking ambient air; and a motor for driving the cooling fan.

In a further another aspect of the present invention, there is provided an air inlet structure of a laundry dryer, including: a base; a blower cover mounted on the base; an air guide disposed between the base and the blower cover, for guiding a sucking ambient air; and a front cabinet disposed in front of the base.

In a still further another aspect of the present invention, there is provided a laundry dryer including: a drum; a motor for driving the drum; a belt disposed along an outer circumference of the drum and an outer circumference of a shaft of the motor; a base in which the motor is disposed, the base including an air inlet for introducing an ambient air and a flow passage for the introduced ambient air; a cooling fan disposed in the base to suck the ambient air; a blower cover for enclosing the flow passage of the base; and a front cabinet disposed in front of the base.

According to the present invention, the noise caused by collision between sucking ambient air and a surface of a base can be reduced, and the loss caused by flow friction can be reduced.

In addition, the air inlet structure is improved such that the suction efficiency of a fan can be increased.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
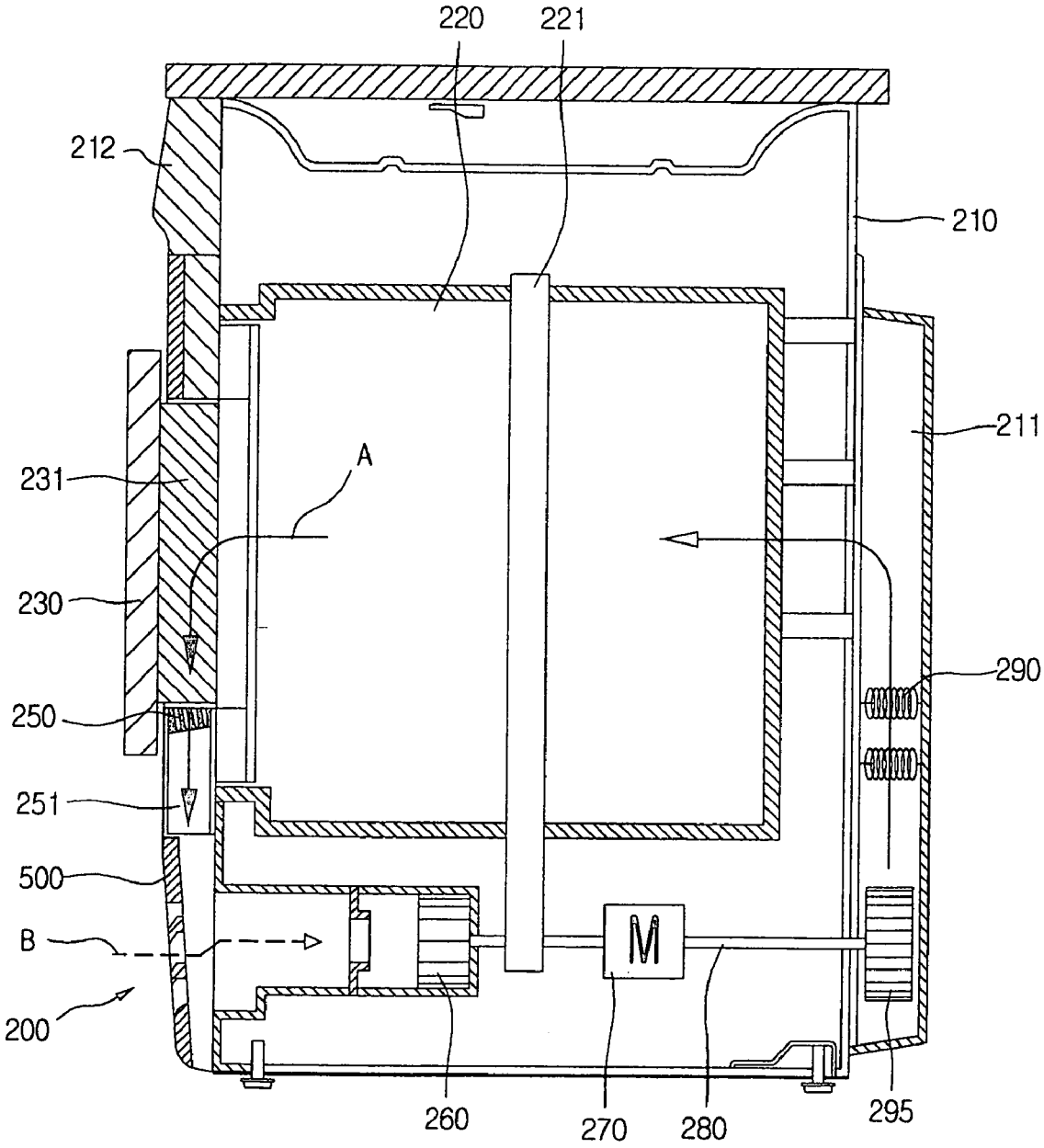
FIG. 1 is a sectional view of a laundry dryer according to the present invention.

FIG. 1 is a sectional view of a condenser-type laundry dryer according to the present invention.

Referring to FIG. 1, a condenser-type laundry dryer 200 includes an outer case 210, a front cabinet 500 installed at a front of the outer case 210, a cylindrical drum 220 mounted in the outer case 210 to receive the laundry therein, a door 230 controlling the opening of the drum 220, and a belt 221 disposed around an outer circumference of the drum 220 to rotate the drum 220. The front cabinet 500 defines a hole for passing air therethrough.

The condenser-type laundry dryer 200 further includes a motor shaft 280 connected to the belt 221 to transmit rotational force to the drum 220, a motor 270 for transmitting the rotational force to the motor shaft 280, and a cooling fan 260 connected to a first end of the motor shaft 280 to rotate by receiving the rotational force of the motor 270 and intake ambient air. The laundry dryer 200 further includes a dry fan 295 connected to a second end of the motor shaft 280 to circulate air in the drum 220 and a duct cover 211 connecting the dry fan 295 to the drum 220 to allow the air introduced by the dry fan 295 to be directed to the drum 220. The cooling fan 260 and the dry fan 295 are disposed facing each other and the motor 270 is disposed between the cooling and dry fan 260 and 295. The dry fan 295 and a heater 290 are received in the duct cover 211 defining an air passage through which the circulation air introduced by the dry fan 295 is directed to a back of the drum 220.

The dryer 200 includes a door lint filter 231 disposed on a rear surface of the door 230 for primarily filtering foreign objects contained in the circulation air and a body lint filter 250 disposed under the door lint filter for secondary filtering foreign objects contained in the circulation air passed through the door lint filter 231. There is provided a circulation duct 251 along which the circulation air passed through the body lint duct 250 is directed to a condenser (refer to 190 in FIG. 2).

The operation of the above-laundry dryer will be described hereinafter.

When electric power is applied to the dryer 200, the motor 270 rotates and the heater 290 mounted in the duct cover 211 is excited. Then, the belt 221 connected to the motor shaft 280 rotates to rotate the drum 220. As the drum 220 rotates, the laundry in the drum 220 is lifted and dropped by the lift (not shown) mounted on the inner wall of the drum 220.

Meanwhile, the dry fan 295 connected to the motor shaft 280 rotates by the rotation of the motor 270 to introduce the circulation air via the condenser. The air flows upward along the duct cover 211 and passes through the heater 290 to be converted into high-temperature/dry air. Then, the air is directed into the drum 220 to absorb the moisture contained in the laundry, thereby being converted into the high-temperature/damp air.

The high-temperature/damp air is directed to the condenser 190 along the circulation duct 251 after passing through the door lint filter 231 and the body lint filter 250.

Meanwhile, as the cooling fan 260 connected to the motor shaft 280 rotates, ambient air is induced into the dryer 200. The ambient air is directed to the condenser 190 via the cooling fan 260. The condenser 190 is designed such that the high-temperature/damp air and the ambient air are not mixed with each other but heat-exchanged.

Accordingly, the high-temperature/damp air gives heat to the ambient air as it goes through the condenser, thereby being changed into low-temperature/damp air, in the course of which the moisture contained in the low-temperature/damp air is condensed. The condensed moisture is dropt on the floor of the condenser 190 and is then directed to a condensed water collector (refer to 150 in FIG. 2)

The moisture directed to the condensed water collector 150 is transmitted to a condensed water storage 212 disposed on an upper portion of the dryer 200. Meanwhile, the ambient air passing trough the condenser takes the heat from the high-temperature/damp air to change the circulation air into the lower-temperature/damp air. As a result, the temperature of the ambient air is increased.

Here, the circulation air introduced by the dry fan 295 flows along the passage defined by the duct cover 211. Then, as it passes through the heater 290, it is changed into the high-temperature/dry air and is then directed into the drum 220.

Figure 2:
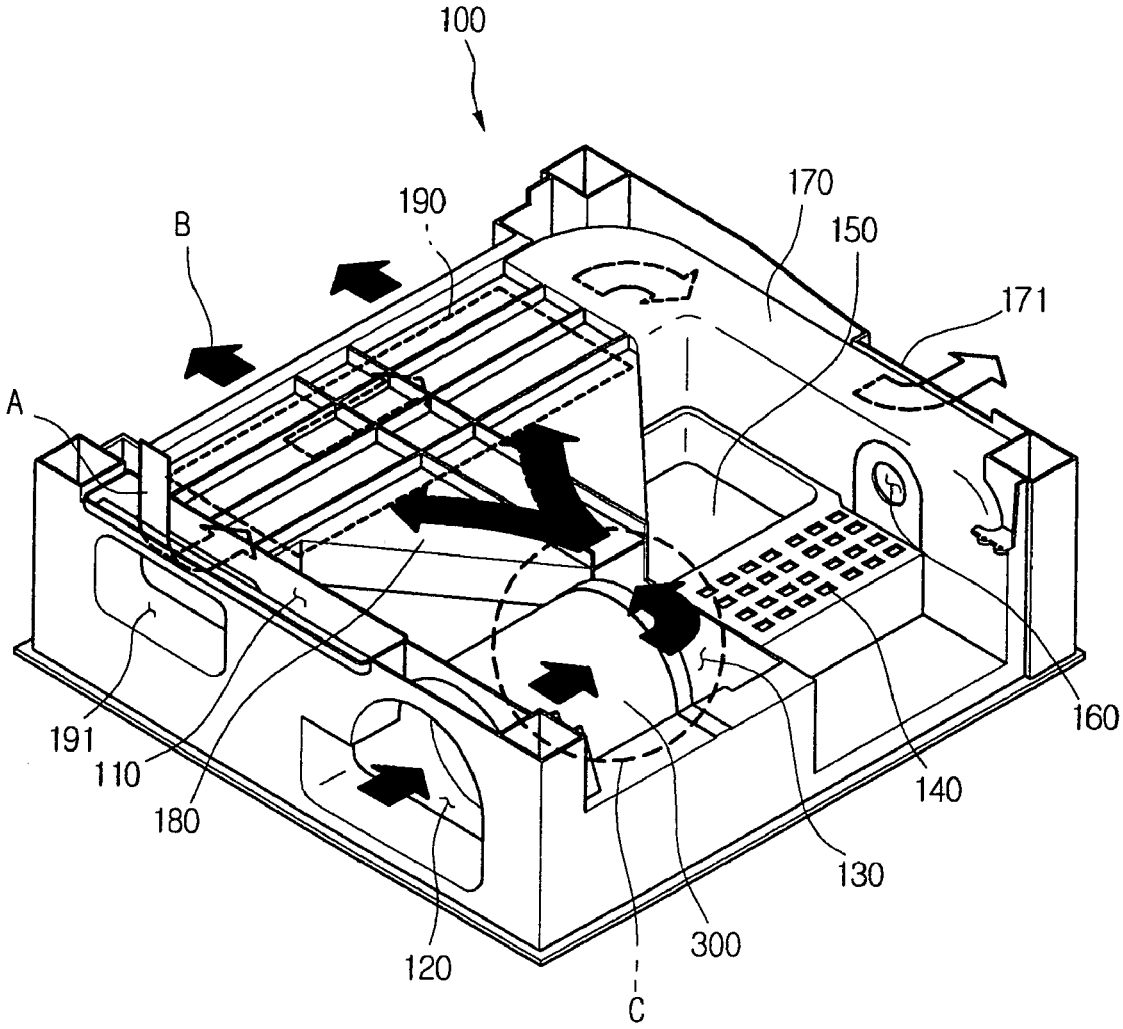
FIG. 2 is a perspective view of a base with an ambient air inlet structure according to the present invention.

FIG. 2 is a perspective view of a base with an ambient air inlet structure according to the present invention.

Referring to FIG. 2, a base 100 includes an air descending part 110, a condenser insertion hole 191, a condenser 190, and a circulation air passage 170. The circulation air enters the base 100 through the air descending part 110 after passing the drum 220 and the door lint filter 231. The condenser insertion hole 191 is defined at a bottom front portion of the air descending part 110. The condenser 190 is inserted though the condenser insertion hole 191 into the base 100. The circulation air passage 170 provides a passage for the circulation air passed the condenser 190.

Further, the base 100 includes an air inlet 120, a fan mounting space 130, a blower tube 300, and air guide 180. The air inlet 120 is defined at a front right of the base 100 to pass ambient air therethrough. The fan mounting space 130 is a place where the cooling fan 260 is mounted. The blower tube 300 provides a passage for the ambient air from the air inlet 120 to the cooling fan 260. The air guide 180 is formed from the fan mounting space 130 to the condenser 190 with an increasing width. Since the cooling fan 260 is a cross flow fan that sucks air in an axial direction and discharges the air in a radial direction, the blower tube 300 and the air guide 180 are connected at a predetermined angle.

Furthermore, the base 100 includes the motor 270 disposed behind the fan mounting space 130 to rotate the drum 220, heat release holes 140 for passing an air heated by the operation of the motor 270, a shaft hole 160 formed at an end of the circulation air passage 170 for inserting the motor shaft, a condensed water collector 150 formed at about center to collect condensed water dropping from the condenser 190.

Hereinafter, the airflow in the base 100 will be more fully described.

The circulation air, which has been heated and damped during passing through the heater 290 and the drum 220, enters the air descending part 110 from the door lint filter 231 and body lint filter 250 and passes through the condenser 190. Ambient air is introduced through the air inlet 120 and is blown to the condenser 190 by the cooling fan 260.

At the condenser 190, the ambient air takes heat from the high-temperature circulation air.

Here, the condenser 190 is designed in a cross structure such that the ambient air and circulation air can exchange heat each other without mixing.

The circulation air passed the condenser 190 moves back to the drum along the circulation air passage 170 and duct cover 211. The ambient air passed the condenser is discharged out of the laundry dryer 200.

Figure 3:
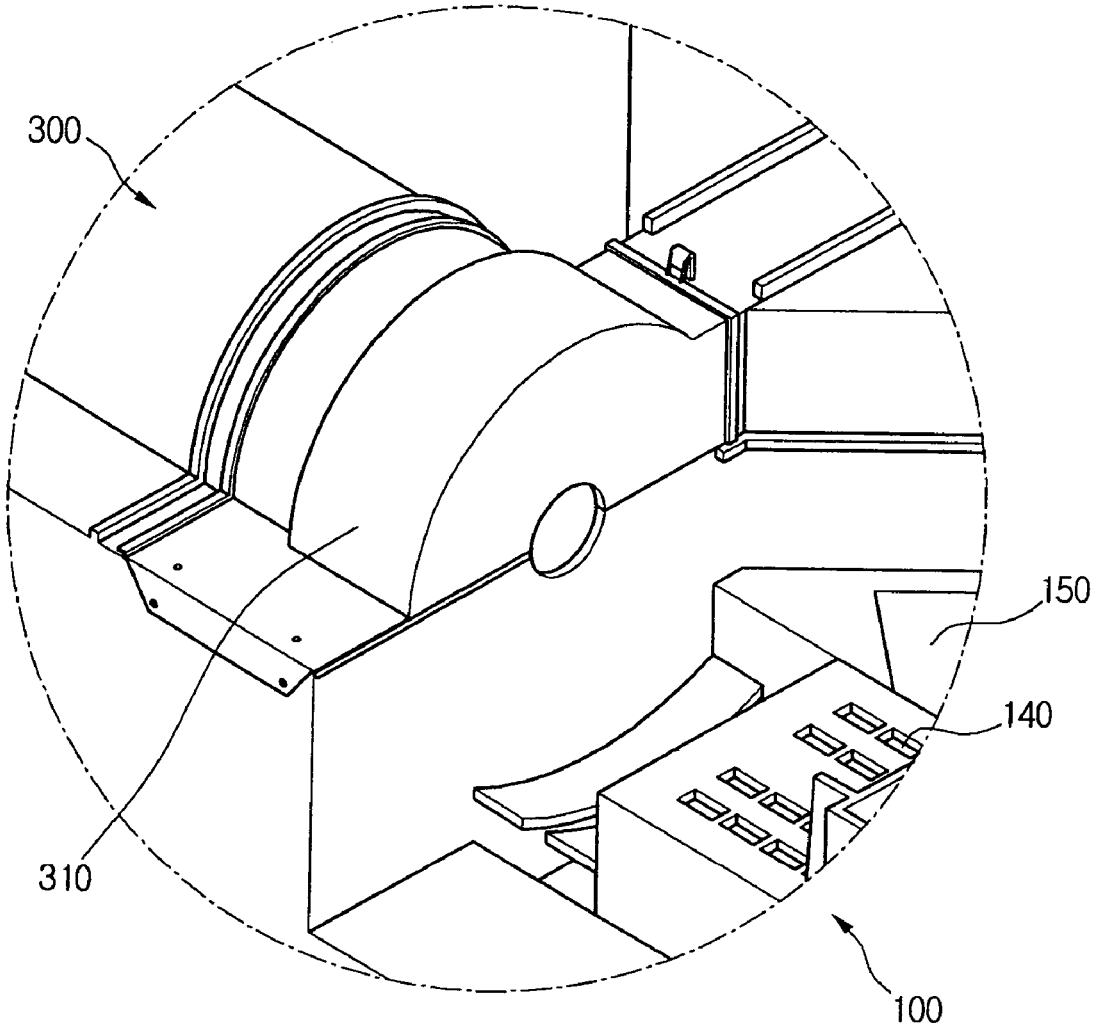
FIG. 3 is an enlarged partial perspective view of a base with an ambient air inlet structure according to the present invention.
Figure 4:
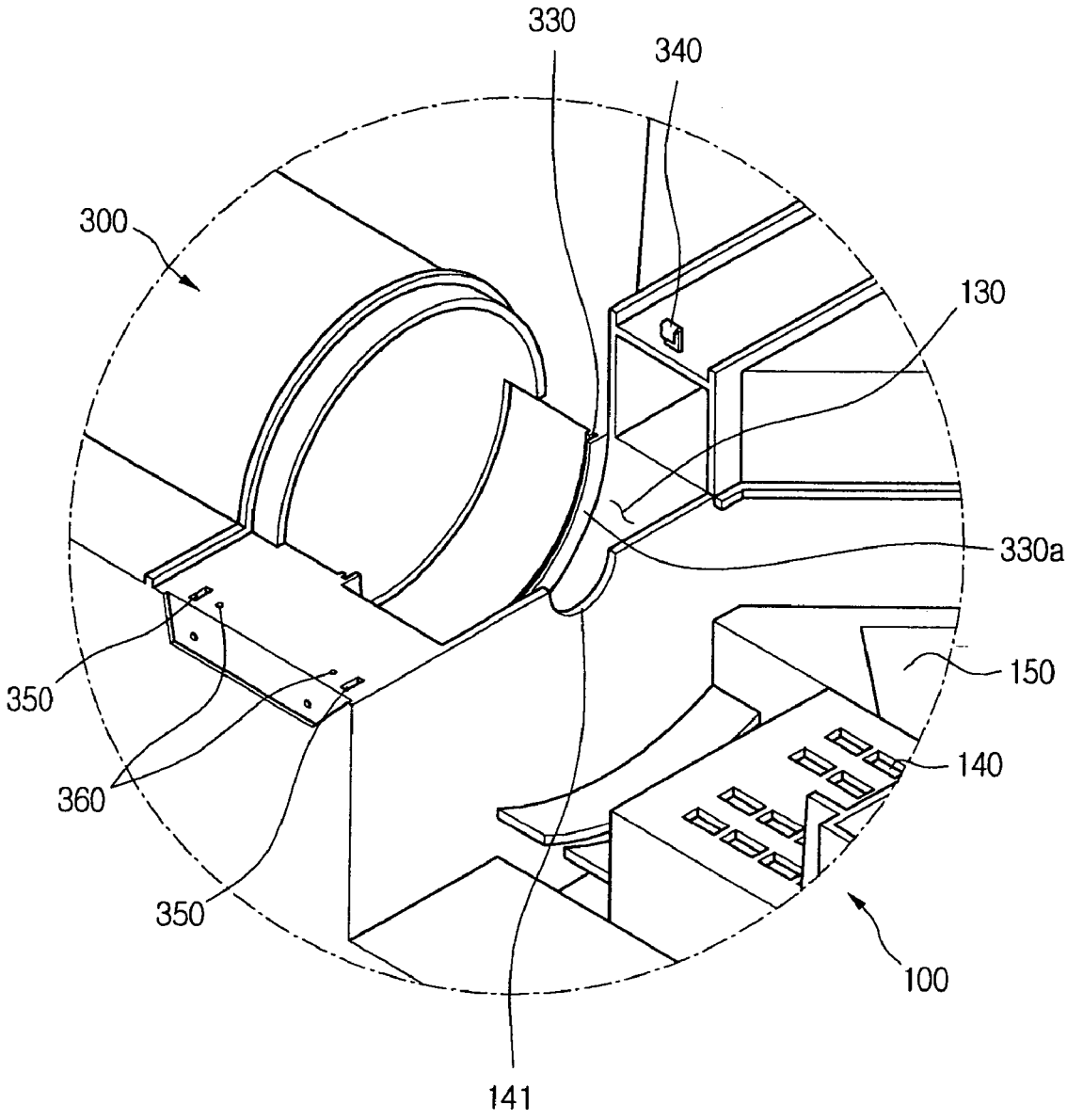
FIG. 4 is an enlarged view of a circular portion "C" depicted in FIG. 2.

FIG. 3 is an enlarged partial perspective view of a base with an ambient air inlet structure according to the present invention, and FIG. 4 is an enlarged view of a circular portion "C" depicted in FIG. 2.

Referring to FIGS. 3 and 4, the base includes a blower tube cover 310 mounted at an exit end of the blower tube 300 to cover the cooling fan 260.

Figure 7:
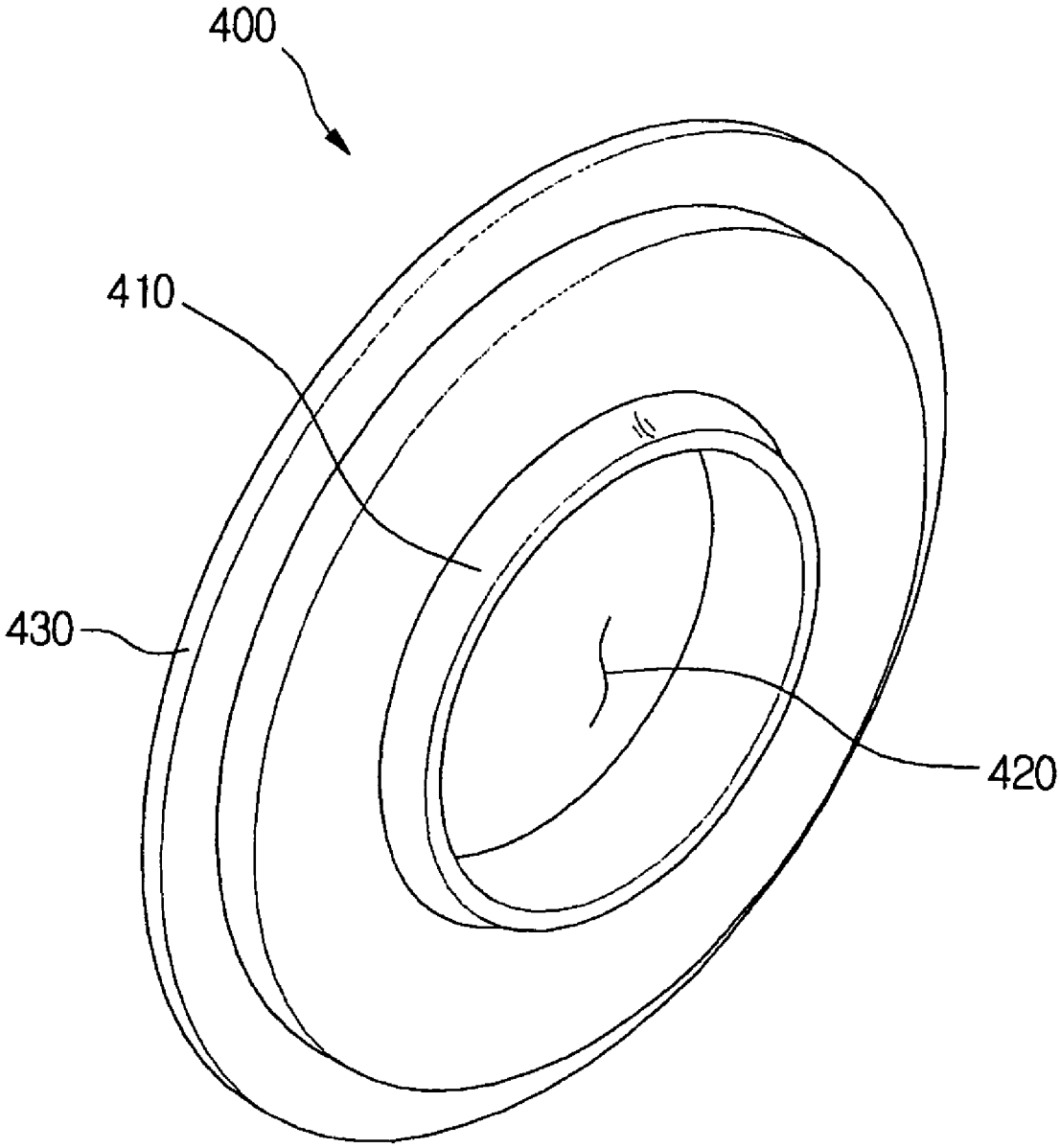
FIG. 7 is a perspective view of an air guide according to the present invention.

The blower tube 300 defines a guide holding groove 330 at an inside of its exit end to hold an air guide (refer to 400 in FIG. 7). The air guide 400 guides the ambient air to the cooling fan 260. In detail, the guide holding groove 330 is defined between two ribs 330*a* that are protruded from the base 100 with predetermined heights and widths. The ribs 330*a* are designed such that the air guide 400 can be inserted into the guide holding groove 330 exactly and tightly. The fan mounting space 130 is defined behind the guide holding groove 330. A tab keeper 340 is formed at an upper surface of the base 100 to fix the blower cover 310.

The tab keeper 340 is protruded upwardly from the upper surface of the base 100 with a predetermined height and of which end is bent downwardly, such that a cover fixing tab, formed at a side end of the blower cover 310 with a corresponding width (refer to 311 in FIG. 5), can be inserted to the tab keeper 340. Also, the base 100 includes guide protrusion pockets 350 at an upper surface opposing to the tab keeper 340 to receive guide protrusions (refer to 313 in FIG. 6)

Further, cover anchoring holes 360 are defined between the guide protrusion pockets 350 to fix the blower cover 310 to the base 100.

Figure 5:
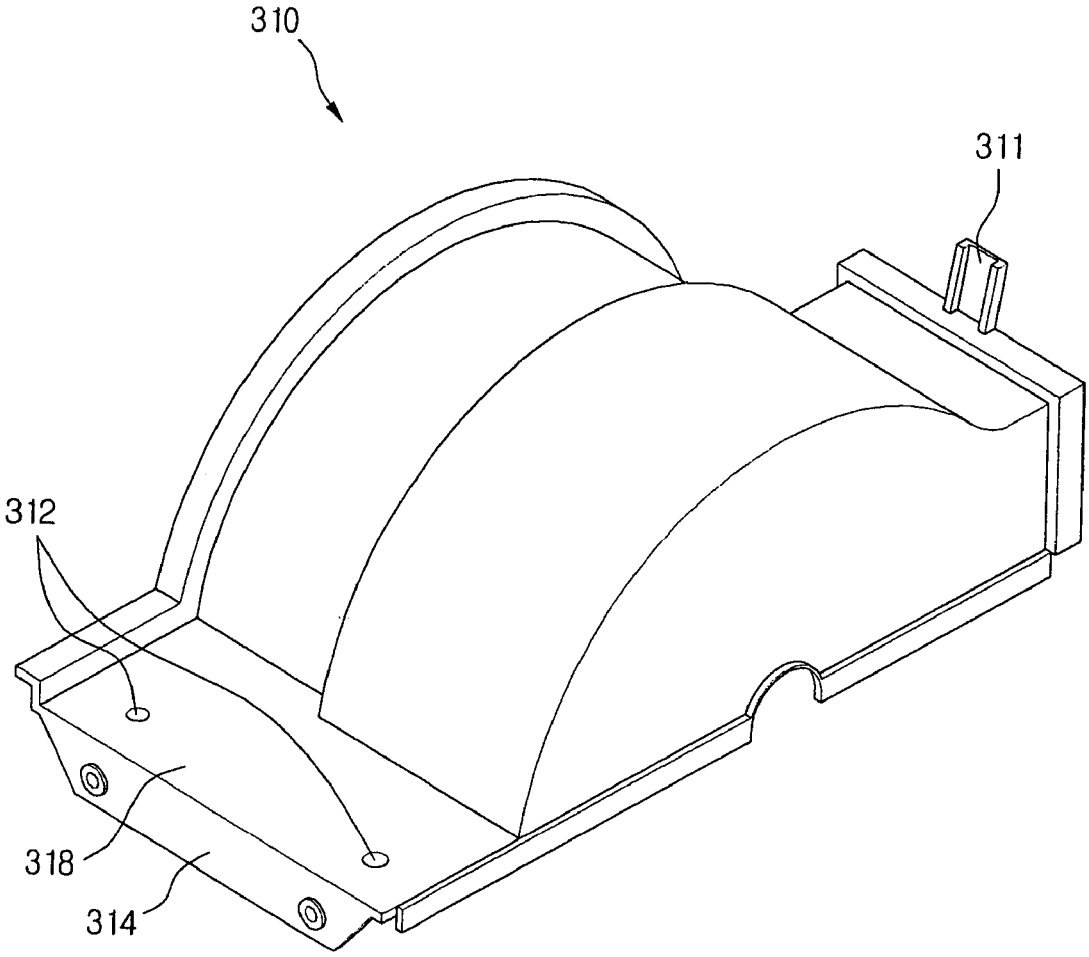
FIG. 5 is a perspective view showing an outside of a blower cover according to the present invention.
Figure 6:
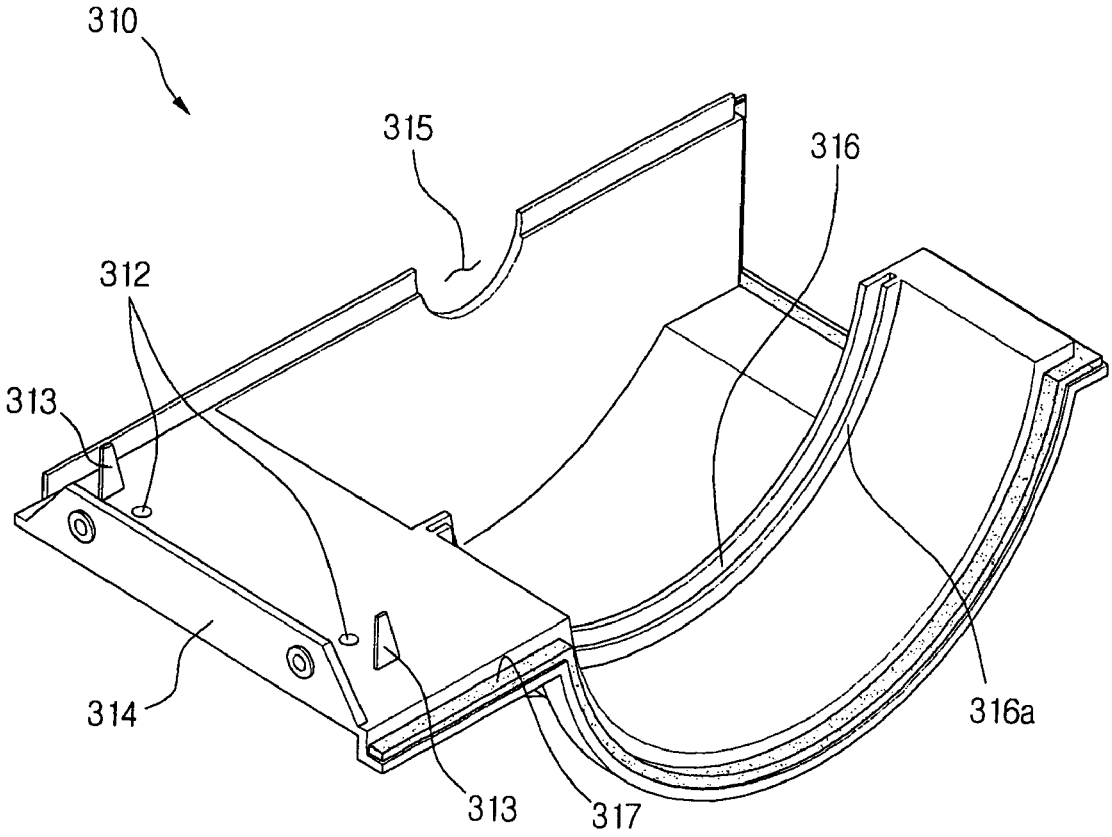
FIG. 6 is a perspective view showing an inside of a blower cover according to the present invention.

FIG. 5 is a perspective view showing an outside of a blower cover according to the present invention, and FIG. 6 is a perspective view showing an inside of a blower cover according to the present invention.

Referring to FIGS. 5 and 6, the blower cover 310, which is to be mounted on the base 100 to form a passage for the introduced ambient air, has a semi-cylindrical shape to cover the cooling fan 260.

The blower cover 310 includes the cover fixing tab 311 projected upwardly with a predetermined height from an end portion, for mounting on the base 100.

Further, the blower cover 310 includes an extended portion 318 at a side end opposing to the cover fixing tab 311, for mounting on the base 100. The extended portion 318 is bent from the side end and extended by a predetermined length. The extended portion 318 includes cover fixing holes 312, in which coupling members are to be inserted for fixing the blower cover 310 on the base 100. Also, the blower cover 310 includes a bent portion 314 that is extended from an end of the extended portion 318 in a downward direction. The bent portion 314 guides the mounting of the blower cover 310 on the base 100 and prevents the blower cover 310 from lateral movement after the mounting. The base 100 may define a recessed portion (not shown) having shape and depth corresponding to the bent portion 314 to receive the bent portion 314 exactly.

Further, the blower cover 310 includes a sealing member 317 attached along its inner edge to be faced with the blower tube 300 in order to prevent the ambient air from leakage. Also, the blower cover 310 defines a guide inserting groove 316 at its inner surface to fix the air guide 400 exactly in the blower cover 310. The blower cover 310 includes ribs 316*a* having predetermined heights and gap therebetween to define the guide inserting groove 316 therebetween. The ribs 316*a* have the same radius of curvature as the air guide 400. The guide inserting groove 316 prevents the air guide 400 from forward and backward movements by the ambient air sucked through the blower tube 300.

Further, blower cover 310 includes a shaft receiving hole 315 to insert the motor shaft 280 to drive the cooling fan 260 with the motor 270. The shape of the shaft receiving hole 315 is semi-circular to face an upper portion of the motor shaft 280. Another shaft receiving hole 141 with a semi-circular shape is formed at the base 100 (refer to FIG. 4) to face a lower portion of the motor shaft 280. Therefore, the shaft receiving hole 315 and shaft receiving hole 141 are facing each other to define a circular hole when the blower cover 310 is mounted on the base.

Further, the blower cover 310 includes the guide protrusions 313 at a bottom side of the extended portion 318. The guide protrusions 313 are protruded downwardly with predetermined lengths to exactly align the cover fixing holes 312 with the cover anchoring holes 360 of the base 100.

Further, as the guide protrusions 313 are inserted into the guide protrusion pockets 350 of the base 100, the guide protrusions 313 guide the mounting of the blower cover 310 on the base 100, and as well prevent the blower cover 310 from movement on the base 100 when the blower cover 310 is mounted on the base 100.

The blower cover 310 is placed above the base 100 with facing its shaft receiving hole 315 with the shaft receiving hole 141 of the base, and the cover fixing tab 311 is inserted into the tab keeper 340. Then, the guide protrusions 313 are inserted into the guide protrusion pockets 350 to abut the extended portion 318 on the upper surface of the base 100. Then, coupling members are inserted into the cover fixing holes 312 and the cover anchoring holes 360 to securely fix the blower cover 310 to the base 100.

Meanwhile, the air guide 400 is erected on the base 100 by inserting it on the guide holding groove 330 of the base 100 prior to mounting the blower cover 310 on the base 100, such that the erected air guide 400 can be inserted into the guide inserting groove 316 when the extended portion 318 is abutted on the upper surface of the base 100.

FIG. 7 is a perspective view of an air guide according to the present invention.

Referring to FIG. 7, the outer diameter of the air guide 400 is the same as the inner diameter of the blower tube 300. The air guide 400 includes a shroud 410 at a center portion and an air passage hole 420 defined in the shroud 410 to pass the ambient air therethrough. The shroud 410 is bent toward the cooling fan 260 to guide the ambient air sucked through the air inlet 120 toward the cooling fan 260. The bent portion of the shroud 410 is smoothly rounded to have a predetermined radius of curvature in order to minimize flow friction. The air guide 400 reduces the pressure of the ambient air flowing therethrough but increases the velocity of the ambient air, thereby increasing the velocity of the ambient air after it passes the cooling fan 260.

Further, the air guide 400 includes a flange 430 along its circumference. The width flange 430 is the same as the widths of the guide holding groove 330 and guide inserting groove 316, and the height of the flange 430 is the same as the depths of the guide holding groove 330 and guide inserting groove 316, such that the flange 430 can be tightly inserted into the guide holding groove 330 and guide inserting groove 316.

As described above, to mount the air guide 400, the flange 430 is inserted into the guide holding groove 330, and then the blower cover 310 of which inner barrier rib 33 is hinged to the tab keeper 340 is rotated down to the base 100, such that the guide inserting groove 316 defined inside the blower cover 310 can be coupled with the air guide 400.

Since the guide holding groove 330 coupled with the air guide 400 make the air guide 400 stand, it is not required to hold the air guide 400 by the hand when the blower cover 310 is mounted on the base 100.

Figure 8:
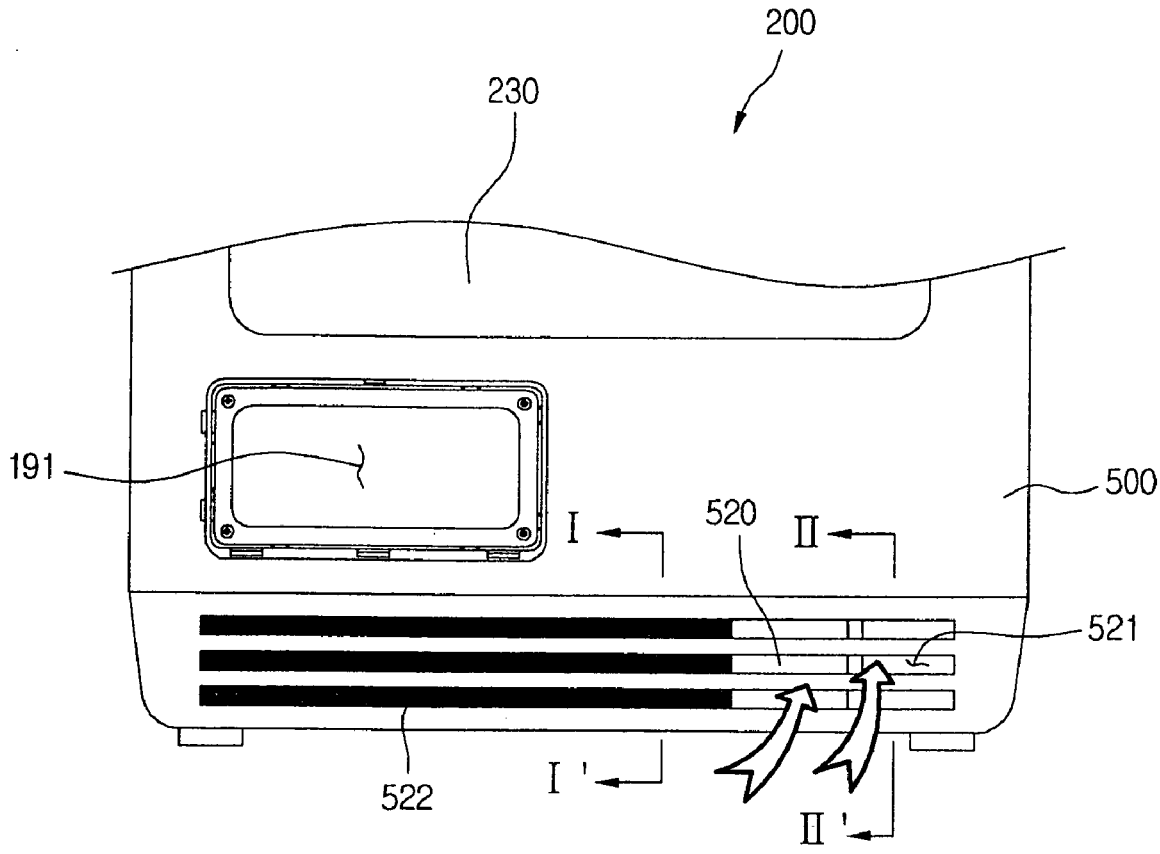
FIG. 8 is a partial front view of a laundry dryer with an air inlet structure according to the present invention.
Figure 9:
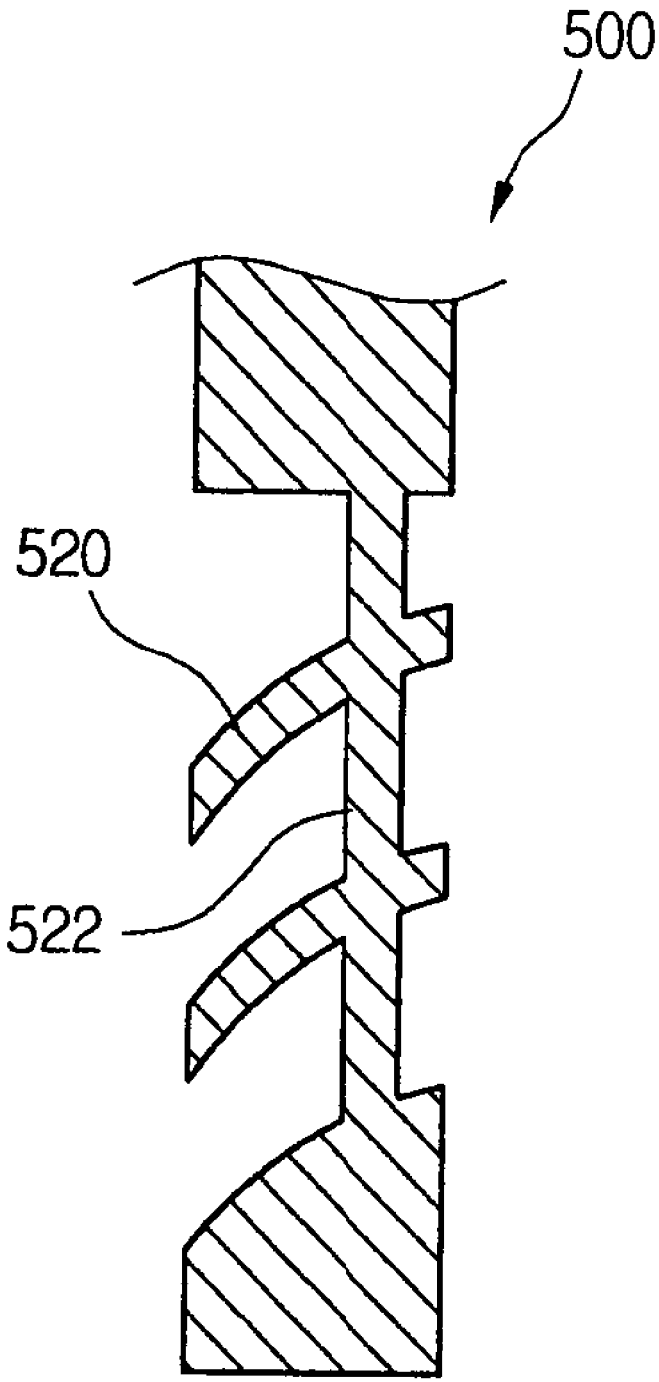
FIG. 9 is a sectional view taken on I-I' line in FIG. 8.
Figure 10:
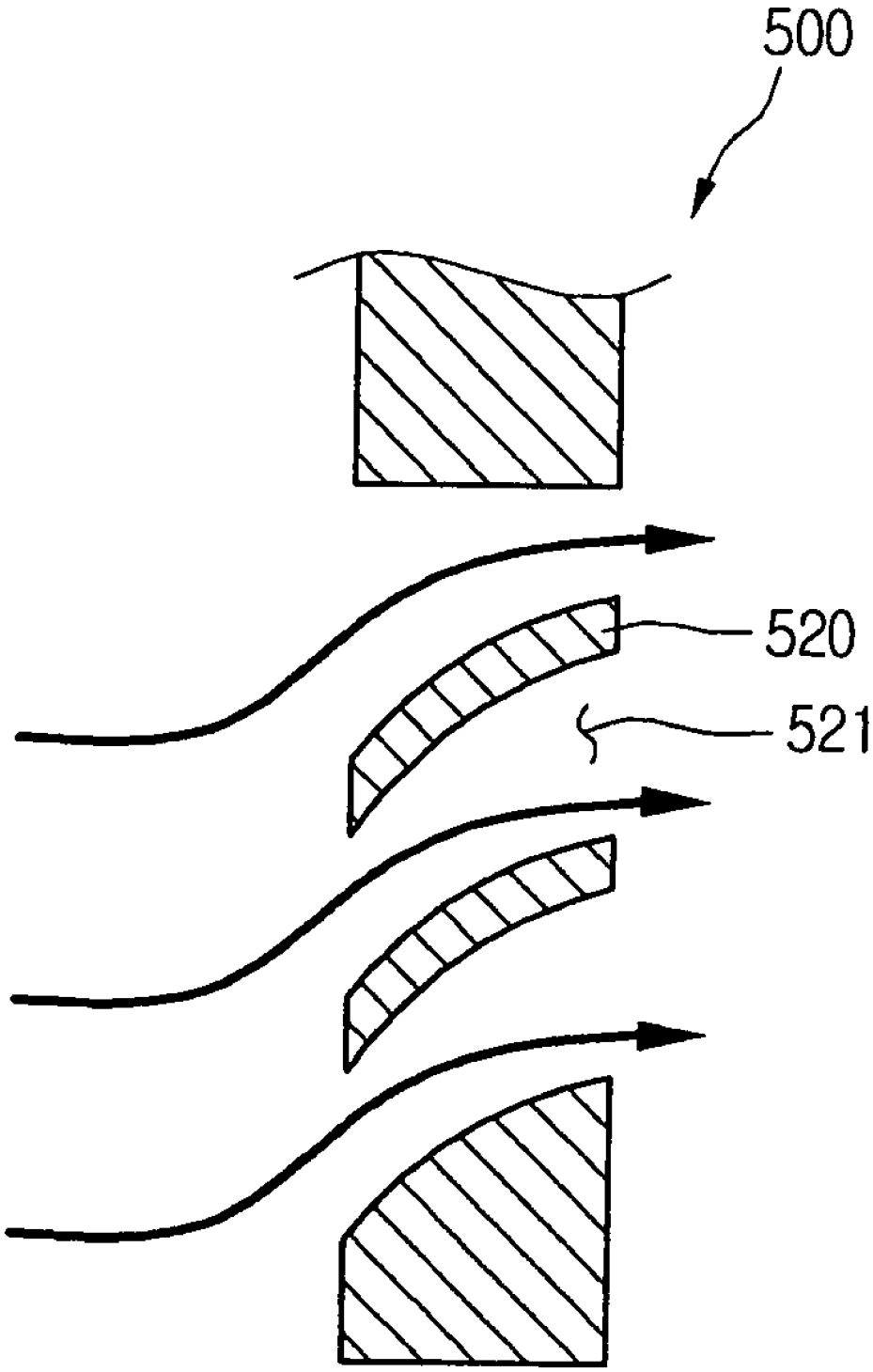
FIG. 10 is a sectional view taken on II-II' line in FIG. 8.

FIG. 8 is a partial front view of a laundry dryer with an air inlet structure according to the present invention, FIG. 9 is a sectional view taken on I-I' line in FIG. 8, and FIG. 10 is a sectional view taken on II-II' line in FIG. 8.

Referring to FIGS. 8 to 10, the front cabinet 500 forms the front external appearance of the laundry dryer 200. The door 230 is attached to the front cabinet 500. The condenser insertion hole 191 is defined under the door 230 to insert the condenser 190. The front cabinet 500 includes a suction hole 522 under the condenser insertion hole 191 to pass the ambient air and a suction grill 520 to cover grill hole 521 in order to guide the suction of the ambient air.

The number of the suction grill 520 may be at least one, and holes are defined among bars of the suction grill 520. The suction hole 521 is defined in front of the base 100 to communicate with the air inlet 120. The bars of the suction grill 520 may be designed to point downward at a predetermined angle in order to reduce suction of foreign substances of the ambient air.

A portion of the suction grill 520, which is not faced with the air inlet 120 of the base 100, is blocked up by an air blocking part 522 in order to prevent the ambient air from passing thought the portion.

The air blocking part 522 is provided to prevent noise that may be produced when the ambient air is sucked through the portion of the suction grill 520 and collided with front surface of the base 100 where the air inlet 120 is not defined. In other words, the holes of the suction grill 520 are defined only in front of the air inlet 120 of the base 100, such that the ambient air can be sucked in a straight line toward the cooling fan 260, and the noise produced by the collision between the ambient air and the front surface of the base can be prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air inlet structure of a laundry dryer for drawing air into the dryer, comprising:

a laundry dryer blower cover including an extended portion bent and extended by a predetermined length from an end thereof, a cover fixing tab protruded upwardly by a predetermined length from the other end thereof, and at least one guide protrusion projected from a bottom surface of the extended portion;

a laundry dryer base on which the blower cover is mounted, the base including an air inlet and a tab keeper to hold the cover fixing tab;

a cooling fan stably disposed between the base and the blower cover, for drawing ambient air into the laundry dryer;

an air guide for altering pressure characteristics of ambient air drawn into the dryer disposed between the base and the blower cover; and a motor for driving the cooling fan.

2. The air inlet structure according to claim 1, wherein the blower cover further includes a shaft receiving hole at a predetermined portion, for supporting a shaft of the motor.

3. The air inlet structure according to claim 1, wherein the cover fixing tab is inserted in the tab keeper, the extended portion is stably seated on the base, and the extended portion is securely fixed to the base with a coupling member, such that the blower cover is mounted on the base.

4. The air inlet structure according to claim 1, wherein the air guide is put on the base and the blower cover enclose the air guide, such that the air guide is disposed between the base and the blower cover.

5. The air inlet structure according to claim 1, further comprising a blower tube to connect an air inlet of the base and the blower cover, wherein the blower cover further includes a rubber sealing member along an inner surface abutting on the blower cover to prevent the sucked ambient air from leakage.

6. The air inlet structure according to claim 1, wherein the cooling fan is disposed behind the air guide to suck the ambient air through the air guide.

7. The air inlet structure according to claim 1, wherein the cooling fan is a cross flow fan.

8. The air inlet structure according to claim 1, wherein the base includes a fan mounting recess.

9. The air inlet structure according to claim 1, wherein the blower cover further includes a bent portion bent downwardly from the extended portion, the extended portion and the bent portion of the blower cover being tightly brought into contact with the base when the blower cover is mounted on the base in order to prevent the base from moving on the base.

10. The air inlet structure according to claim 1, wherein the blower cover further includes at least one guide protrusion projected from a bottom surface, and the base further includes at least one guide protrusion pocket for receiving the at least one guide protrusion.

11. The air inlet structure according to claim 1, wherein the blower cover further includes a rib along an inner surface to support the air guide, and/or the base further includes a rib along an inner surface to support the air guide.

12. The air inlet structure according to claim 1, wherein the air guide includes a shroud at a center portion, the shroud being bent and extended toward the cooling fan.

13. The air inlet structure of claim 1, wherein the base is a unitary structure.

14. An air inlet structure of a laundry dryer for drawing air into the dryer, comprising:

a laundry dryer blower cover including an extended portion bent and extended by a predetermined length from an end thereof, a cover fixing tab protruded upwardly by a predetermined length from the other end thereof, and at least one guide protrusion projected from a bottom surface of the extended portion;

a laundry dryer base on which the blower cover is mounted, the base including an air inlet and a tab keeper to hold the cover fixing tab;

a cooling fan stably disposed between the base and the blower cover, for drawing ambient air into the laundry dryer;

an air guide for altering flow friction characteristics of ambient air drawn into the dryer disposed between the base and the blower cover; and a motor for driving the cooling fan.

* * * * *